US006912367B2

(12) United States Patent
Miura

(10) Patent No.: US 6,912,367 B2
(45) Date of Patent: Jun. 28, 2005

(54) FIXING UNIT

(75) Inventor: Tatsuyuki Miura, Fujisawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/610,710

(22) Filed: Jul. 2, 2003

(65) Prior Publication Data

US 2004/0005163 A1 Jan. 8, 2004

(30) Foreign Application Priority Data

Jul. 3, 2002 (JP) ..... 2002-195113

(51) Int. Cl.[7] ..... G03G 15/20
(52) U.S. Cl. ..... 399/69; 219/216
(58) Field of Search ..... 399/67, 69, 70, 399/320; 219/216, 600, 662, 663

(56) References Cited

U.S. PATENT DOCUMENTS 6,630,651 B2 * 10/2003 Ohishi et al. ..... 219/662

FOREIGN PATENT DOCUMENTS

| | | | |
|---|---|---|---|
| JP | 58-90676 | * | 5/1983 |
| JP | 8-76620 | A | 3/1996 |
| JP | 9-120222 | A | 5/1997 |
| JP | 9-258586 | A | 10/1997 |
| JP | 2003-91186 | * | 3/2003 |

* cited by examiner

*Primary Examiner*—Hoan Tran
(74) *Attorney, Agent, or Firm*—Foley & Lardner LLP

(57) ABSTRACT

A fixing unit includes an inductor which heats a heating roller by electromagnetic induction, the heating roller serving as a heat source which fixes toner supplied to a paper sheet, and a heat control circuit which supplies radio-frequency power to the inductor. Particularly, the heat control circuit is set such that the radio-frequency power is changed in a stepwise manner to increase and reduce the temperature of the heating roller.

8 Claims, 4 Drawing Sheets

FIXING UNIT

CROSS-REFERENCE TO RELATED APPLICATIONS

This application is based upon and claims the benefit of priority from the prior Japanese Patent Application No. 2002-195113, filed Jul. 3, 2002, the entire contents of which are incorporated herein by reference.

BACKGROUND OF THE INVENTION

1. Field of the Invention

The present invention relates to a heating unit of an induction heating type, and more particularly to a fixing unit for thermally fixing a toner image on a paper sheet, the toner image having been visualized by toner used as a developer in an electronic photography type copying machine or printer.

2. Description of the Related Art

Japanese Patent Application KOKAI Publication No. 8-76620 has proposed a fixing unit that utilizes induction heating instead of a halogen lamp or heat resistive film. This fixing unit heats a conductive film by magnetic field generation means, and fixes toner on a paper sheet set in tight contact with the conductive film. In the fixing unit, a heat generation belt serving as the conductive film is interposed between a press roller and an assembly serving as the magnetic field generation means to form a nip. Further, Japanese Patent Application KOKAI Publication No. 9-258586 has proposed a fixing unit using a heat generator that has a coil wound around a core disposed along the rotation shaft of a fixing roller and induces eddy currents in the fixing roller to generate a heat.

For the above-described induction heating fixing unit, Japanese Patent Application KOKAI Publication No. 9-120222 discloses a soft-start technique for gradually increasing the power output to a coil up to a predetermined value, in order to suppress a flicker phenomenon that occurs in, for example, an illumination instrument due to power consumption abruptly increased when an RF current begins to flow in the coil. However, the flicker phenomenon depends on a power change per unit time that occurs when the temperature is increased or reduced. Therefore, in the prior art, a sufficiently long setup time is required, which delays the first copying operation. Furthermore, in recent copying machines or the like, for the purpose of power saving, after a predetermined time period elapses after a copying operation, the copy ready state is shifted to a pre-heating state, and then a warm-up state, this state shifting being repeated again and again. However, the power saving effect is reduced if a lot of time is required to increase or reduce the temperature.

BRIEF SUMMARY OF THE INVENTION

An object of the invention is to provide a fixing unit capable of reliably suppressing a flicker phenomenon that occurs in a peripheral illumination instrument even if the fixing unit uses an induction coil as a heat source for induction heating, the fixing unit being also capable of shortening the required warm-up time and hence reducing the consumption of power.

To attain the object, the present invention provides a fixing unit comprising: an inductor which heats an object by electromagnetic induction, the object serving as a heat source which fixes a developer supplied to a fixing target to which the developer is to be fixed; and a heat control circuit which supplies radio-frequency power to the inductor, the heat control circuit being set such that the radio-frequency power is changed in a stepwise manner to increase and reduce a temperature of the object.

In this fixing unit, the supplied power can be maximized within the power range of each step to attain efficient heating with the flicker phenomenon reliably suppressed. As a result, the time required for warming up is shortened to thereby reduce the power consumption. Even if the inductor has a structure that employs alternately-driven first and second induction coils and more easily causes the flicker phenomenon in peripheral illumination instruments than in the case of using a single coil, stepwise change of radio-frequency power is performed to increase or reduce the temperature of the object, with the result that large variations in power consumption are suppressed, therefore the occurrence of the flicker phenomenon is suppressed in a highly reliable manner.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

A digital copying machine serving as an image forming apparatus according to an embodiment of the invention will be described with reference to the accompanying drawings.

Figure 1:
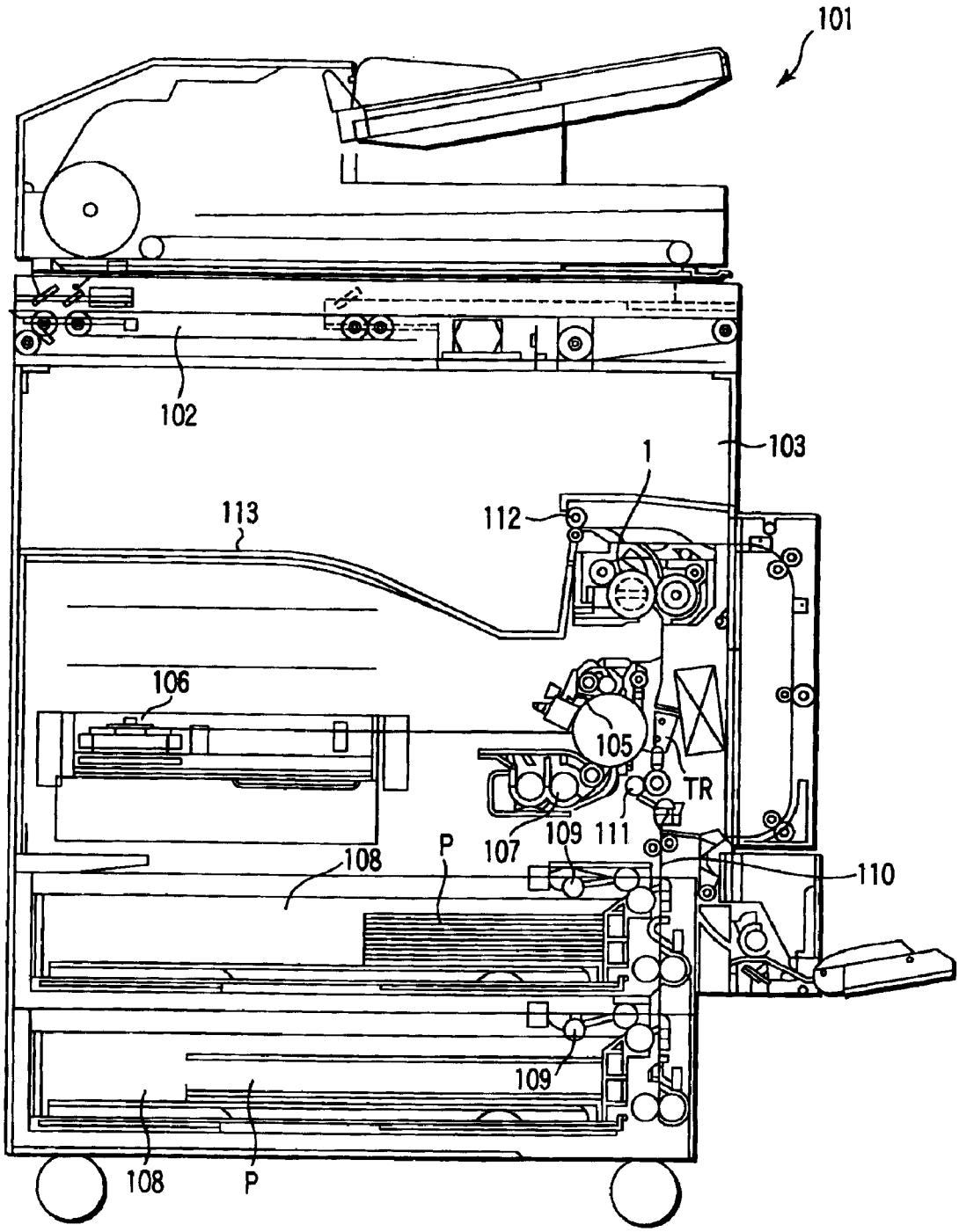
FIG. 1 is a schematic view illustrating the internal structure of a digital copying machine according to an embodiment of the invention.

FIG. 1 schematically shows the internal structure of the digital copying machine 101. The digital copying machine 101 comprises a scanner 102 serving as an image reading unit which read an image of the original document and generates a digital image signal indicative of the image by optically scanning the original document and photoelectric-converting light reflected from the original document. The machine 101 also comprises an image forming section 103 for forming, on a paper sheet P, an image corresponding to a digital image signal output from the scanner 102 or an external device.

The image forming section 103 comprises a cylindrical photosensitive drum 105, exposure unit 106, developing unit 107, transfer unit TR and fixing unit 1 of an induction heating type, etc. The photosensitive drum 105 has an outer peripheral surface that is formed of a photosensitive layer and exposed to light in a state charged to a predetermined potential. The exposure unit 106 irradiates the photosensitive layer of the photosensitive drum 105 with a laser beam of an intensity that varies with image information supplied from the scanner 102 or external device, thereby forming an electrostatic latent image corresponding to the potential of the photosensitive layer varied in an exposed part. The potential of the photosensitive layer is maintained for a predetermined period of time to enable the electrostatic latent image to be developed and transferred. The developing unit 107 supplies, as a developer, toner, to the photosensitive layer of the photosensitive drum 105, thereby developing the electrostatic latent image. The electrostatic latent image is thus visualized as a toner image by the toner attached to the electrostatic latent image on the photosensitive layer. The transfer unit TR charges a paper sheet P fed as a transfer target to a transfer position that opposes the photosensitive drum 105, thereby transferring the toner image on the photosensitive drum 105 to the paper sheet P. Paper sheets P are picked up by a pickup roller 109 one by one from a paper cassette 108, and are conveyed via a conveyance path 110 to an aligning roller 111 adjacent to the transfer position. The aligning roller 111 feeds each paper sheet P so that the paper sheet P is positioned at the transfer position when a toner image on the photosensitive drum 105 reaches the transfer position. The fixing unit 1 applies heat and pressure to the paper sheet P to thereby press-fix the melted toner on the paper sheet P. The toner-fixed paper sheet P is supplied from the fixing unit 1 to a discharge roller 112 and discharged by the roller 112 into a discharge tray 113.

Figure 2:
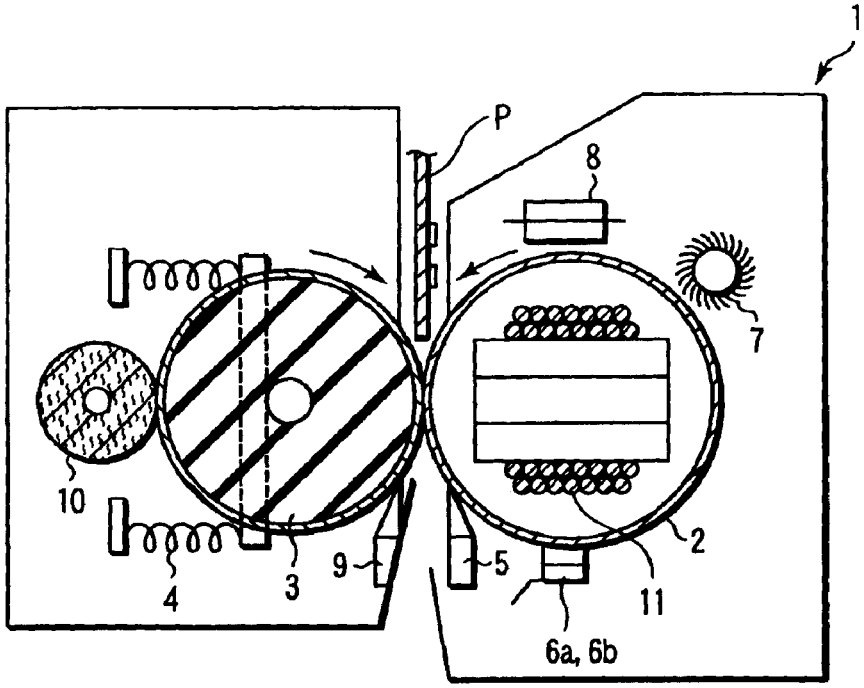
FIG. 2 is a transverse sectional view of a fixing unit shown in FIG. 1.
Figure 3:
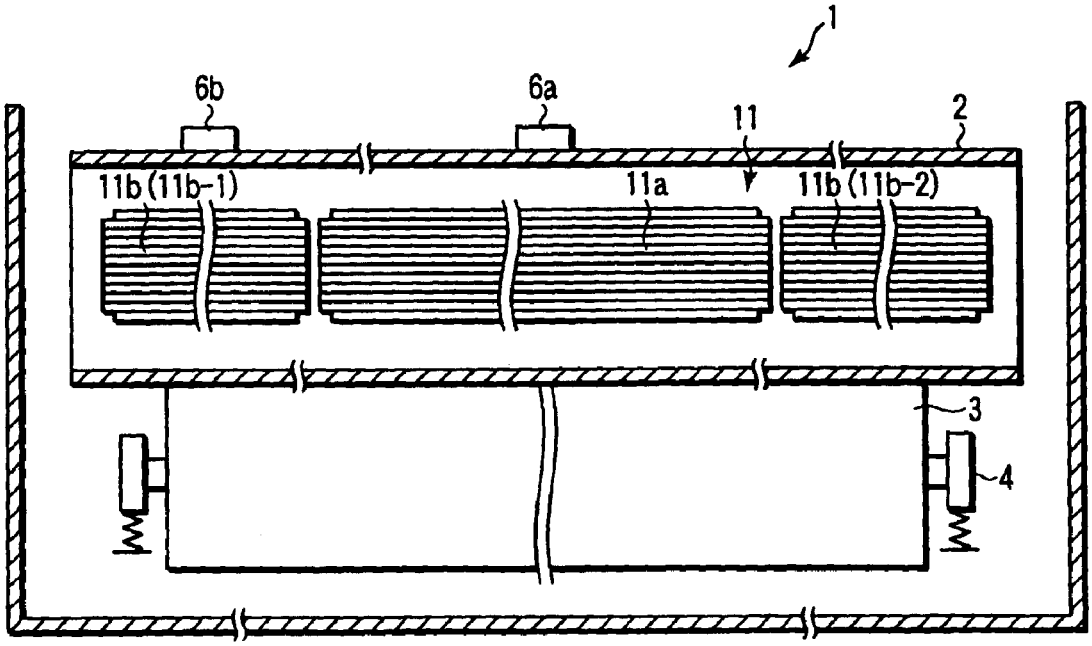
FIG. 3 is a longitudinal sectional view of the fixing unit shown in FIG. 1.

FIG. 2 is a transverse sectional view of the fixing unit 1, and FIG. 3 is a longitudinal sectional view of the fixing unit 1. The fixing unit 1 comprises a heating roller 2 with a diameter of about 50 mm, and a press roller 3 with a diameter of about 50 mm.

The heating roller 2 is formed of a hollow metal member, iron in this embodiment, with a thickness of about 1.5 mm. The heating roller 2 is coated with a mold release layer (not shown) that is formed by depositing, to a predetermined thickness, a fluorocarbon resin represented by polytetrafluoroethylene, which is known as Teflon (trademark). The heating roller 2 is formed of stainless steel, an alloy of stainless steel and aluminum, etc. The heating roller 2 has a length of about 340 mm. Instead of the heating roller 2, a metal film may be used, which is in the shape of an endless belt formed by depositing a metal on a highly thermal resistive resin film to a predetermined thickness.

The press roller 3 is an elastic roller formed by coating a shaft of a predetermined diameter with silicone rubber or fluorocarbon rubber to a predetermined thickness. The press roller 3 has a length of about 320 mm. The shaft of the press roller 3 is substantially parallel to that of the heating roller 2. The press roller 3 is pressed against the heating roller 2 with a predetermined pressure by a pressure mechanism 4. As a result, part of the outer periphery of the heating roller 2 is elastically deformed, thereby providing a predetermined nip defined between the rollers. In the case where the metal film is used instead of the heating roller 2, a nip may be imparted to the film side.

The heating roller 2 is rotated at a substantially constant speed in the direction indicated by the arrow in FIG. 2, by a driving force supplied from a fixing motor 123 or a main motor 121 that rotates the photosensitive drum 105. Since the press roller 3 is kept in contact with the heating roller 2 with a predetermined pressure by the pressure mechanism 4, it rotates in the direction opposite to the rotational direction of the heating roller 2 when the heating roller 2 is rotated.

The fixing unit 1 has a separation pawl 5 for separating, from the heating roller 2, each paper sheet P having passed through the nip between the heating roller 2 and press roller 3. The separation pawl 5 is located on the outer periphery of the heating roller 2 adjacent to and downstream of the nip with respect to the rotational direction of the heating roller 2. The fixing unit 1 also has a pair of temperature sensing elements 6*a* and 6*b*, cleaner 7 and heat-generation error-detecting element 8, which are opposed to the outer periphery of the heating roller 2 and arranged in the rotational direction of the heating roller 2. The temperature sensing elements 6*a* and 6*b* sense temperatures of the outer peripheral portions of the heating roller 2.

The temperature sensing elements 6*a* and 6*b* are, for example, thermistors, one of which is located at the substantial center of the heating roller 2 in the longitudinal direction, and the other of which is located at one end of the heating roller 2 in the longitudinal direction. These thermistors are located on the outer periphery of the heating roller 2 at arbitrary positions at which they are not influenced by the magnetic fields of coils, described later.

The cleaner 7 removes toner, paper dust, etc. stuck to a fluorocarbon resin layer on the outer periphery of the heating roller 2. The cleaner 7 comprises a cleaning member and support member supporting the cleaning member. The cleaning member is formed of a material, such as felt, a fir brush, etc., that does not damage the fluorocarbon resin layer of the heating roller 2 when brought into contact with it.

The heat-generation error-detecting element 8 is, for example, a thermostat, and is used to detect an abnormality in heat generation, for example, when the surface temperature of the heating roller 2 is excessive. If an abnormality is detected, the element 8 cuts off power to the induction coil for heating, described later. A separation pawl 9 for separating each paper sheet P from the press roller 3, and a cleaning roller 10 for removing toner from the periphery of the press roller 3 are provided on the periphery of the press roller 3.

The heating roller 2 contains an excitation inductor 11 for generating eddy currents in the heating roller 2. In the example of FIG. 3, the excitation inductor 11 comprises a center coil 11*a* located in a central portion of the heating roller 2 in the longitudinal direction and an end coil 11*b* located in end parts of the heating roller 2. The end coil 11*b* is formed of a wire material having substantially the same resistance and sectional area (the same number of twisted threads) as the center coil 11*a*, and has substantially the same number of turns as the center coil 11*a*. The end coil 11*b* includes two portions 11*b*-1 and 11*b*-2 located on both sides of the center coil 11*a* in the axial direction of the heating roller 2, and is capable of outputting the amount of energy equivalent to that of the center coil 11*a*.

The center coil 11*a* heats the area including the center of the heating roller 2 in the longitudinal direction, while the end coil 11*b* heats the areas adjacent to the both ends of the heating roller 2. The center coil 11*a* has a length that enables heating of a paper sheet of, for example, size A4 that is conveyed with its short sides parallel to the axis of the heating roller 2 and brought into contact with the outer periphery of the heating roller 2.

Each coil 11*a* or 11*b* of the excitation inductor 11 is formed of a number (16 in this embodiment) of litz wires. These litz wires are formed by stranding copper wires with a diameter of, for example, 0.5 mm that are isolated from each other using a heat resistive polyamide or polyimide.

The coils 11*a* and 11*b* are secured to a support member formed of, for example, a metal, via a coil holder made of a high heat-resistant/low electrical conductivity engineering plastic or ceramic. The coil holder may be formed of PEEK (polyethylethylketone), a phenol, an unsaturated polyester, etc.

The coils 11*a* and 11*b* may be air-core coils that are only held by a coil holder without a support member. The coils 11*a* and 11*b* are wound using an arbitrary method. The inductor 11 may be flat coils arranged on the inner periphery of the heating roller 2.

Figure 4:
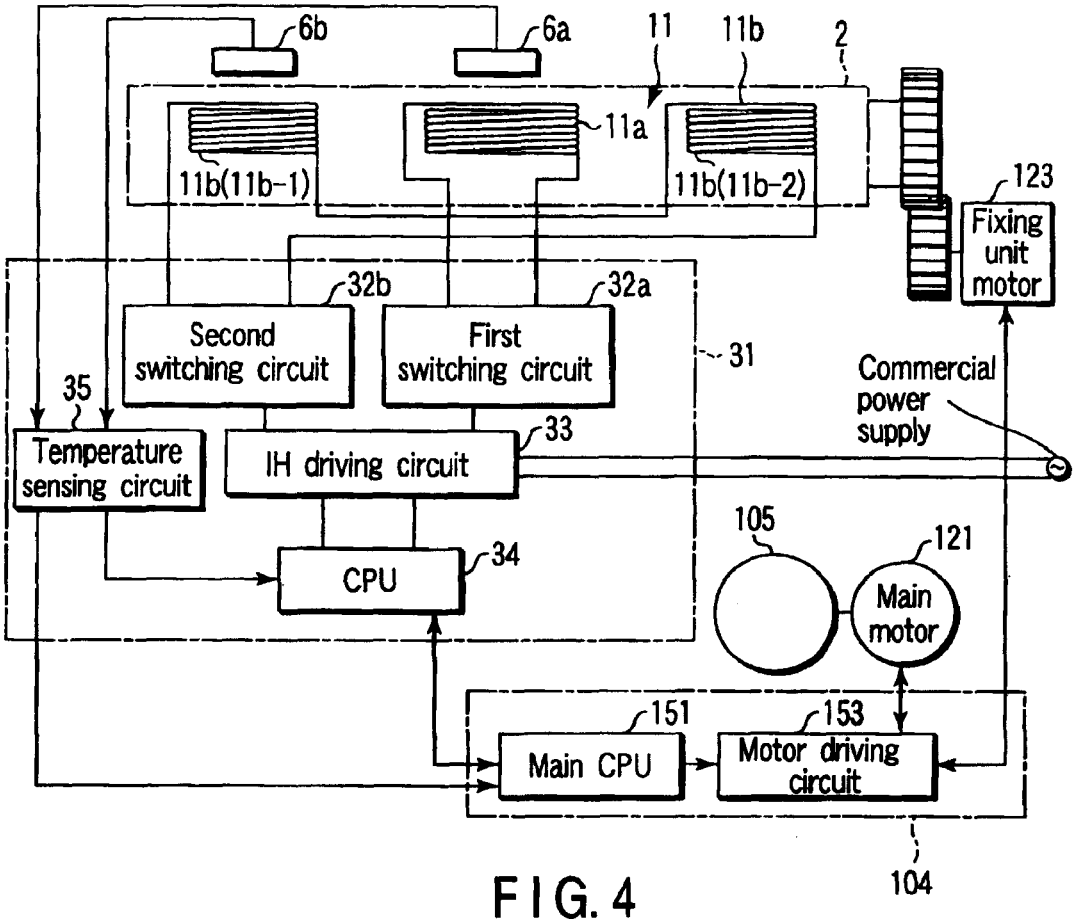
FIG. 4 is a circuit diagram illustrating an example of a heat control circuit for the fixing unit shown in FIG. 1.

FIG. 4 shows an example of a heat control circuit for the fixing unit. As seen from FIG. 4, the heat control circuit has a heat control unit 31 and a control circuit 104 incorporated in the image forming section 103. The heat control unit 31 comprises first and second switching circuits 32*a* and 32*b* formed of inverter circuits, IH driving circuit 33 for driving the switching circuits 32*a* and 32*b*, temperature sensing circuit 35 for analog-to-digital converting the temperatures sensed by the temperature sensing elements 6*a* and 6*b* to temperature data, and CPU 34 for controlling the IH driving circuit 33 on the basis of the results of sensing obtained from the temperature sensing circuit 35. The center coil 11*a* is connected to the first switching circuit 32*a*, and the end coil 11*b* is connected to the second switching circuit 32*b*.

The switching circuits 32*a* and 32*b* change the frequency of an external commercial power supply (AC power supply) in accordance with driving signals from the IH driving circuit 33, and supply power of the changed frequencies to the coils 11*a* and 11*b*, respectively. Thus, the power supplied to the coils 11*a* and 11*b* is controlled. The voltage across the coil 11*a* and that across the coil 11*b* vary with the frequency of the power supply voltage.

The IH driving circuit 33 is controlled by the CPU 34 and drive the switching circuits 32*a* and 32*b* to supply outputs of controlled RF power to the coils 11*a* and 11*b*. Specifically, the IH driving circuit 33 changes the frequency of the power supply voltage to thereby change the voltages across the coils 11*a* and 11*b* to adjust the RF current flowing through the coils 11*a* and 11*b*. Thus, the power applied to each coil can be set to an arbitrary value.

The temperature sensing circuit 35 analog-to-digital converts the temperature of the peripheral surface corresponding to the central portion of the heating roller 2, and that of the peripheral surface corresponding to the end portion of the heating roller 2, which are sensed by the temperature sensing elements 6*a* and 6*b*, respectively. In the control of the IH driving circuit 33, the CPU 34 determines the RF power output from the switching circuits 32*a* and 32*b* on the basis of temperature data supplied from the temperature sensing circuit 35. The CPU 34 has a rewritable memory that stores data containing the relationship between temperature data and RF power outputs, the timings of driving the switching circuits 32*a* and 32*b*, etc. The data in the memory can be rewritten to cope with the power supply circumstances in each country or area in which the copy machine 101 is installed, or the maximum input power allowable for the copy machine 101. The CPU 34 is connected to the control circuit 104 incorporated in the image forming section 103. The control circuit 104 comprises a main CPU 151 for controlling the CPU 34 on the basis of temperature data from the temperature sensing circuit 35, a main motor 121, and a motor driving circuit 153 for driving the main motor 121 and the fixing motor 123.

In the above-described fixing unit, the heating roller 2 generates heat in the following manner. When RF power outputs from the switching circuits 32*a* and 32*b* shown in FIG. 4 are supplied to the coils 11*a* and 11*b*, respectively, magnetic fluxes of predetermined directions are generated from the coils 11*a* and 11*b* according to the frequencies of the RF power outputs and the configurations of the coils 11*a* and 11*b*. In the metal portion of the heating rollers 2, magnetic fluxes and eddy currents are generated to resist a change in the magnetic field caused by the magnetic fluxes from the coils 11*a* and 11*b*. As a result, Joule heat occurs in the metal portion of the heating roller 2 because of the eddy currents and the resistance of the metal portion. Using this Joule heat, the heating roller 2 heats each paper sheet P passing between the heating roller 2 and press roller 3.

The operation of the above-described fixing unit will now be described. During a warm-up period for copy operation, the IH driving circuit 33 drives the switching circuit 32*a* to supply RF power to the central coil 11*a*, under the control of the CPU 34. The other switching circuit 32*b* is not driven until the surface temperature of the heating roller 2 reaches a fixable temperature by the heat resulting from the magnetic flux of the center coil 11*a*. As a result, no power is supplied to the end coil 11*b*.

The surface temperature of the heating roller 2 is continuously monitored by the temperature sensing elements 6*a* and 6*b*. Outputs from these elements are analog-to-digital converted by the temperature sensing circuit 35 and input to the CPU 34.

Figure 5:
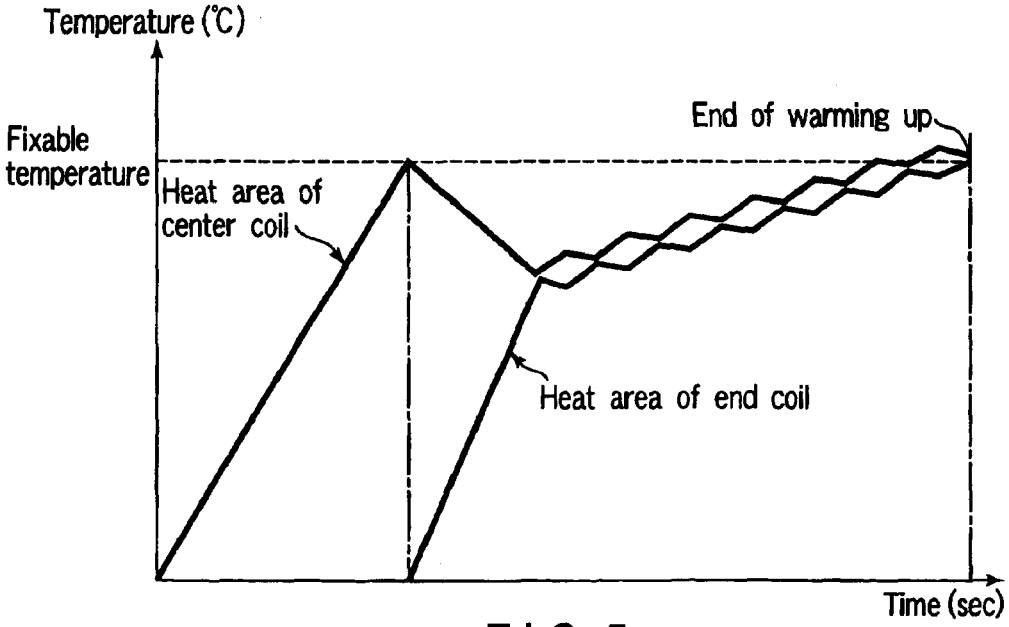
FIG. 5 is a graph illustrating temperature changes occurring in center and end areas of a heating roller during the control of the heat control circuit shown in FIG. 4.

When it is detected by the temperature sensing element 6*a* that the surface temperature in the central portion of the heating roller 2 has reached a predetermined value, and the detection result is supplied to the CPU 34 via the temperature sensing circuit 35, the flow of a current to the central coil 11*a*, i.e., the supply of the output of the driving circuit 33 to the switching circuit 32*a*, is stopped, as shown in FIG. 5. Subsequently, the supply of the output of the driving circuit 33 to the switching circuit 32*b* is started. As a result, RF power is supplied to the end coil 11*b* located at the end portions of the heating roller 2.

The peripheral surface corresponding to the end portions of the heating roller 2 is heated to a predetermined temperature by the coil 11*b* that is supplied with RF power. During this period, the supply of power to the coil 11*a* is stopped, therefore the surface temperature in the central portion of the heating roller 2 gradually lowers.

When the surface temperature in the end portions of the heating roller 2 become substantially equal to that in the central portion of the heating roller 2, the supply of RF power to the coils 11*a* and 11*b* is alternately executed. This alternate driving of the coils 11*a* and 11*b* is continued until the temperature of the heating roller 2 reaches a fixable temperature of 200° C.

During the warm-up period, the frequency of RF power output is increased in a stepwise manner to a predetermined frequency that corresponds to the fixable temperature. Further, the surface temperature of the heating roller 2 is maintained at the fixable temperature during a copy period in which a copying operation is performed, and during a copy-ready period subsequent to the copy period, and is reduced to a pre-heating temperature, lower than the fixable temperature, in a pre-heating period subsequent to the copy-ready period, in which the heating roller 2 is pre-heated. During the pre-heating period, the frequency of RF power is gradually reduced. In the above control, the coils 11*a* and 11*b* are alternately driven on the basis of the temperatures sensed by the first and second temperature sensing elements 6*a* and 6*b*.

Figure 6:
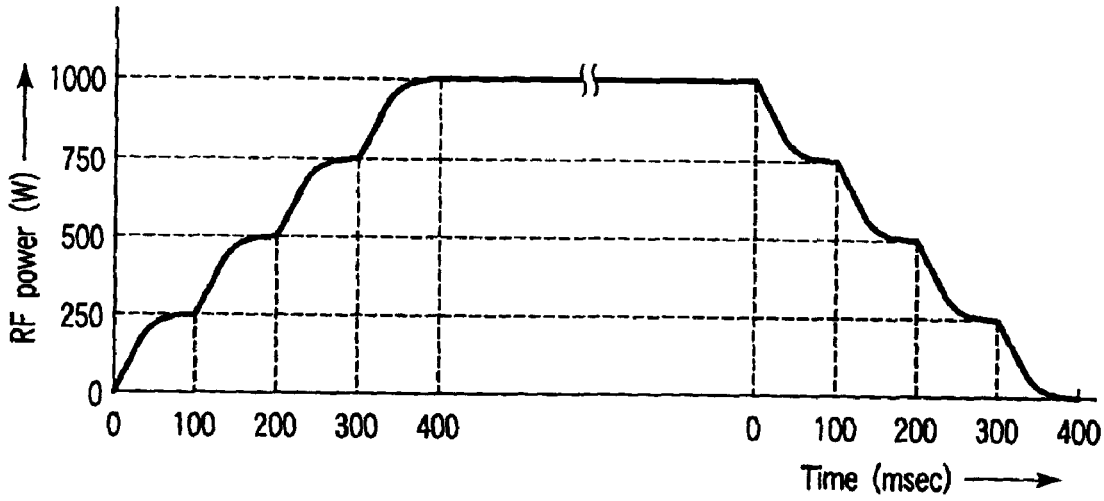
FIG. 6 is a graph illustrating RF power that changes in a stepwise manner under the control of the heat control circuit shown in FIG. 4.
Figure 7:
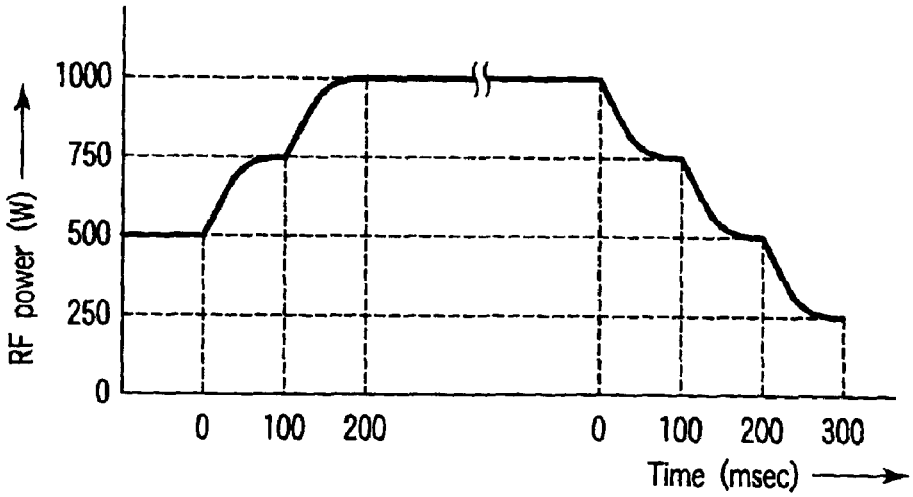
FIG. 7 is a graph illustrating RF power that changes in a stepwise manner under the control of the heat control circuit shown in FIG. 4, in the case where the initial and final values of the RF power are determined by a pre-heating temperature.

If the maximum RF power is, for example, 1000W, to warm the heating roller 2 up to the fixable temperature, the RF power supplied to the coils 11*a* and 11*b* is increased gradually, in the order of 0W, 250W, 500W, 750W and 1000W as shown in FIG. 6. Conversely, to cool down the heating roller 2 from the fixable temperature, the RF power is gradually reduced in the order of 1000W, 750W, 500W, 250W and 0W as also shown in FIG. 6. Further, to increase the temperature of the heating roller 2 from the pre-heating temperature to the fixable temperature, the initial RF power supplied to the coils 11*a* and 11*b* is set to 500W, and the RF power is gradually increased in the order of 500W, 750W and 1000W, as is shown in FIG. 7. Similarly, to reduce the temperature of the heating roller 2 from the fixable temperature to the pre-heating temperature, the final RF power supplied to the coils 11*a* and 11*b* is set to 250W, and the RF power is gradually reduced in the order of 1000W, 750W, 500W and 250W, as is also shown in FIG. 7. The step rate and step interval of the RF power are adjustable, according to, for example, the characteristics of the heat control unit 31 and heating roller 2.

When the coils 11*a* and 11*b* are alternately driven using different RF power outputs, a flicker phenomenon often occurs in peripheral illumination instruments because of the large voltage variations caused by RF power output switching. To avoid this, the heat control unit 31 executes control to keep, within a predetermined range, the difference between the RF power outputs supplied to the central coil 11*a* and that to the end coil 11*b*.

A structure wherein alternately-driven coils 11*a* and 11*b* are used as heat sources more easily causes the flicker phenomenon in peripheral illumination instruments than in the case of using a single coil. However, this embodiment employs a structure in which, in order to increase and reduce the temperature of the heating roller 2, the RF power supplied to the coils is not directly increased and reduced to target values in one step, but is increased and reduced gradually, in a stepwise manner. As a result, large variations in power consumption are suppressed, thereby suppressing the occurrence of the flicker phenomenon in a highly reliable manner.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing unit comprising:

a coil which heats an object by electromagnetic induction, said object serving as a heat source which fixes a developer supplied to a fixing target to which the developer is to be fixed; and a heat control circuit which supplies radio-frequency power to said coil, said radio-frequency power being increased in a stepwise manner at a time of initiating the supply of power and being decreased in a stepwise manner at a time of completing the supply of power.

2. The fixing unit according to claim 1, wherein a rate of change in the radio-frequency power per unit time is constant.

3. A fixing unit comprising:

first and second coils which heat an object by electromagnetic induction, said object serving as a heat source which fixes a developer supplied to a fixing target to which the developer is to be fixed; and said heat control circuit is configured to alternately execute supply of radio-frequency power to said first coil and supply of radio-frequency power to said second coil, said radio-frequency power being increased in a stepwise manner at a time of initiating the supply of power and being decreased in a stepwise manner at a time of completing the supply of power.

4. The fixing unit according to claim 3, wherein said heat control circuit is configured to maintain a difference between radio-frequency power supplied to the first coil and radio-frequency power supplied to the second coil, within a predetermined range.

5. A fixing method comprising:

heating an object by electromagnetic induction from a coil, said object serving as a heat source which fixes a developer supplied to a fixing target to which the developer is to be fixed; and supplying radio-frequency power to said coil, the radio-frequency power being increased in a stepwise manner at a time of initiating the supply of power and being decreased in a stepwise manner at a time of completing the supply of power.

6. The fixing method according to claim 5, wherein a rate of change in the radio-frequency power per unit time is constant.

7. A fixing method comprising:

heating an object by electromagnetic induction from first and second coils, said object serving as a heat source which fixes a developer supplied to a fixing target to which the developer is to be fixed; and alternately executing supply of radio-frequency power to said first induction coil and supply of radio-frequency power to said second induction coil, said radio-frequency power being increased in a stepwise manner at a time of initiating the supply of power and being decreased in a stepwise manner at a time of completing the supply of power.

8. The fixing method according to claim 7, wherein a difference between radio-frequency power supplied to the first coil and radio-frequency power supplied to the second coil are maintained within a predetermined range.

* * * * *